US006172693B1

(12) United States Patent
Minemoto et al.

(10) Patent No.: US 6,172,693 B1
(45) Date of Patent: Jan. 9, 2001

(54) INK JET RECORDING HEAD HAVING INK STIRRING ELECTRODES FOR DISPERSING INK

(75) Inventors: Hitoshi Minemoto; Yoshihiro Hagiwara; Junichi Suetsugu; Tadashi Mizoguchi; Hitoshi Takemoto; Kazuo Shima; Toru Yakushiji, all of Niigata (JP)

(73) Assignee: NEC Corporation, Tokyo (JP)

( * ) Notice: Under 35 U.S.C. 154(b), the term of this patent shall be extended for 0 days.

(21) Appl. No.: 08/978,424

(22) Filed: Nov. 25, 1997

(30) Foreign Application Priority Data

| | | |
|---|---|---|
| Nov. 26, 1996 | (JP) | 8-315130 |
| Nov. 28, 1996 | (JP) | 8-318306 |
| Nov. 28, 1996 | (JP) | 8-318307 |
| Nov. 28, 1996 | (JP) | 8-318308 |

(51) Int. Cl.[7] ..... B41J 2/06
(52) U.S. Cl. ..... 347/55
(58) Field of Search ..... 347/55, 120, 123, 347/111, 159, 141, 151, 122, 128, 17, 103, 154

(56) References Cited

FOREIGN PATENT DOCUMENTS

| | | | | |
|---|---|---|---|---|
| 0703080 | * | 3/1996 | (EP) | 347/55 |
| 405208499 | * | 8/1993 | (JP) | 347/55 |
| 406234219 | * | 8/1994 | (JP) | 347/55 |
| 8-90825 | | 4/1996 | (JP) . | |
| 8-207307 | | 8/1996 | (JP) . | |
| 8-309993 | | 11/1996 | (JP) . | |
| WO 93/11866 | | 6/1993 | (WO) . | |

* cited by examiner

*Primary Examiner*—John Barlow
*Assistant Examiner*—Raquel Yvette Gordon
(74) *Attorney, Agent, or Firm*—Young & Thompson

(57) ABSTRACT

An ink jet recording head comprises a plurality of electrophoretic electrodes corresponding to a plurality of ejecting electrodes, and a pair of stirring electrodes disposed at both ends of the row of the ejecting electrodes. The stirring of the colored particles by the stirring electrodes prevents block of an ink jet slit by the concentrated colored particles, whereas individual control of the electrophoretic electrodes prevents undesirable ink ejection from non-specified ejecting electrode.

7 Claims, 15 Drawing Sheets

VOLT
a
b1
c
b2
d
V1
T1
T1
110
0

VOLT
Tab
Tab
Vab
105
0
−Vab

VOLT
Vab
106
0
−Vab

VOLT
T2
T2
112
V2
0

117

T2
T2
118

VOLT
a
b
c
b
d
V1
T1
119

VOLT
V1
T1
120
0

VOLT
121
0

VOLT
Tab
Tab
Vab
105
0
−Vab

VOLT
Vab
106
0
−Vab

VOLT
T2
T2
112
V2
0

VOLT
T2
T2
117
V2
0

VOLT
T2
T2
118
0 volt
119
V1
0 volt
120
V1
0 volt
121
V1
0
Ts
Ts volt
V4
V1
V3
105
0

V4
V1
V3
106
0

V4
V1
V3
110
0

V4
V1
V3
122
0

112
V2
T2
0

117
V2
0 volt
118
V2
0

INK JET RECORDING HEAD HAVING INK STIRRING ELECTRODES FOR DISPERSING INK

BACKGROUND OF THE INVENTION

Field of the Invention

The present invention relates to an ink jet recording head and, more particularly, to an ink jet recording head capable of controlling the movement of colored particles in a pigmented ink by an electrophoretic force.

Non-impact recording methods attract a large attention in a-printing technology for their low noise during a recording operation. Among other non-impact recording methods, an ink jet recording method has several advantages of direct and high-speed printing onto a recording medium such as a plain paper. A variety of proposals are presented heretofore for improving the ink jet recording head.

A conventional ink jet recording head, such as described in JP-A-60(1985)-228162, comprises a plurality of ejecting electrodes and a counter electrode disposed behind a recording paper. A driving voltage is applied between a specified ejecting electrode and the counter electrode to generate an electric field, which applies an electrostatic force for ejecting colored particles in a pigmented ink from the ejecting electrode.

FIG. 1 shows a conventional ink jet recording head of the type as described above. The ink jet recording head comprises an ink chamber 301 having an ink jet slit 302 for ejecting therefrom colored particles in pigmented ink 310, an electrophoretic electrode 303 disposed at a rear wall of the ink chamber 301 for concentrating colored particles in the pigmented ink in the vicinity of the ink jet slit 302, a plurality of elongate, ejecting electrodes 305 arranged in a row along the ink jet slit 302 for ejecting ink droplets 311 of the colored particles from a specified ejecting electrode 305, and a counter electrode 309 disposed behind a recording medium or paper 304 for generating an electric field between the specified ejecting electrode 305 and the counter electrode 309.

Ink jet slit 302 is separated by separating walls 308 into a plurality of short channels each corresponding to one of the ejecting electrodes 305, thereby forming a meniscus of the pigmented ink 310 at each ejecting electrode 305. The ink chamber 301 is communicated to an ink reservoir not shown in the drawing by tubes connected to the ink inlet port 306 and an ink outlet port 307 for circulating the pigmented ink 310 by a back pressure applied to the pigmented ink in the ink chamber 301.

FIG. 2 shows voltage waveforms applied to the electrophoretic electrode and the ejecting electrodes of FIG. 1. The ink jet recording head utilizes an electrophoretic force by which the charged or electrified colored particles in the pigmented ink are moved in a specified direction.

Specifically, an electric field is generated in the ink chamber 301, which is filled with the pigmented ink, by applying a constant electrophoretic voltage V1, as shown in FIG. 2, to the electrophoretic electrode 303. The colored particles in the pigmented ink are moved by the electric field toward the ink jet slit 302 at a constant electrophoretic mobility and concentrated therein, thereby forming an ink meniscus at the front tip of each ejecting electrode 305. After the ejecting electrode 305 specified for ink ejection receives a voltage pulse having an amplitude of V2 and a duration of T2, the colored particles are further moved toward and concentrated at the tip of the specified ejecting electrode 305.

The colored particles overcomes the meniscus force, surface tension and viscosity of the pigmented ink by virtue of the electrostatic force and are ejected from the tip of the specified ejecting electrode 305, forming minute ink droplets 311, in accordance with the timing in synchrony with the voltage pulse, to adhere to the recording medium 304. The operation described above is repeated until a desired image is formed on the recording medium 304.

SUMMARY OF THE INVENTION

It is an object of the present invention to provide an ink jet recording head capable of preventing the colored particles from being ejected from the tip of an ejecting electrode other than the specified ejecting electrode, thereby obtaining a stable operation of the ink jet recording head and an excellent image quality.

The present invention provides, in one aspect thereof, an ink jet recording head comprising an ink jet recording head comprising a housing defining an ink chamber having an ink jet slit at a front side thereof for ejecting colored particles in pigmented ink, at least one electrophoretic electrode disposed at a rear side of the ink chamber for receiving an electrophoretic voltage for moving the colored particles by an electrophoretic force, a plurality of ejecting electrodes having respective tips arranged in a row along the ink jet slit, each of the ejecting electrodes receiving an ejecting voltage, a counter electrode opposed to the row of tips of the ejecting electrodes and maintained at a potential, and a pair of stirring electrodes disposed at both ends of rows of tips of the ejecting electrodes for receiving a stirring voltage therebetween, the stirring voltage reversing its polarity at least once.

The present invention also provides, in another aspect thereof, an ink jet recording head comprising a housing defining an ink chamber having an ink jet slit at a front side thereof for ejecting colored particles in pigmented ink, a plurality of electrophoretic electrodes arranged at a rear side of the ink chamber, each of the electrophoretic electrodes receiving an electrophoretic voltage for moving the colored particles by an electrophoretic force, a plurality of ejecting electrodes disposed corresponding to the electrophoretic electrodes and having respective tips arranged in a row along the ink jet slit, each of the ejecting electrodes receiving an ejecting voltage, and a counter electrode opposed to the row of tips of ejecting electrodes and maintained at a potential.

In accordance with the ink jet recording head of the present invention, colored particles are prevented from being ejected by an ejecting electrode other than the specified ejecting electrode for obtaining a stable operation of the ink jet recording head and an excellent image quality.

The above and other objects, features and advantages of the present invention will be more apparent from the following description, referring to the accompanying drawings.

DESCRIPTION OF THE PREFERRED EMBODIMENTS

Figure 1:
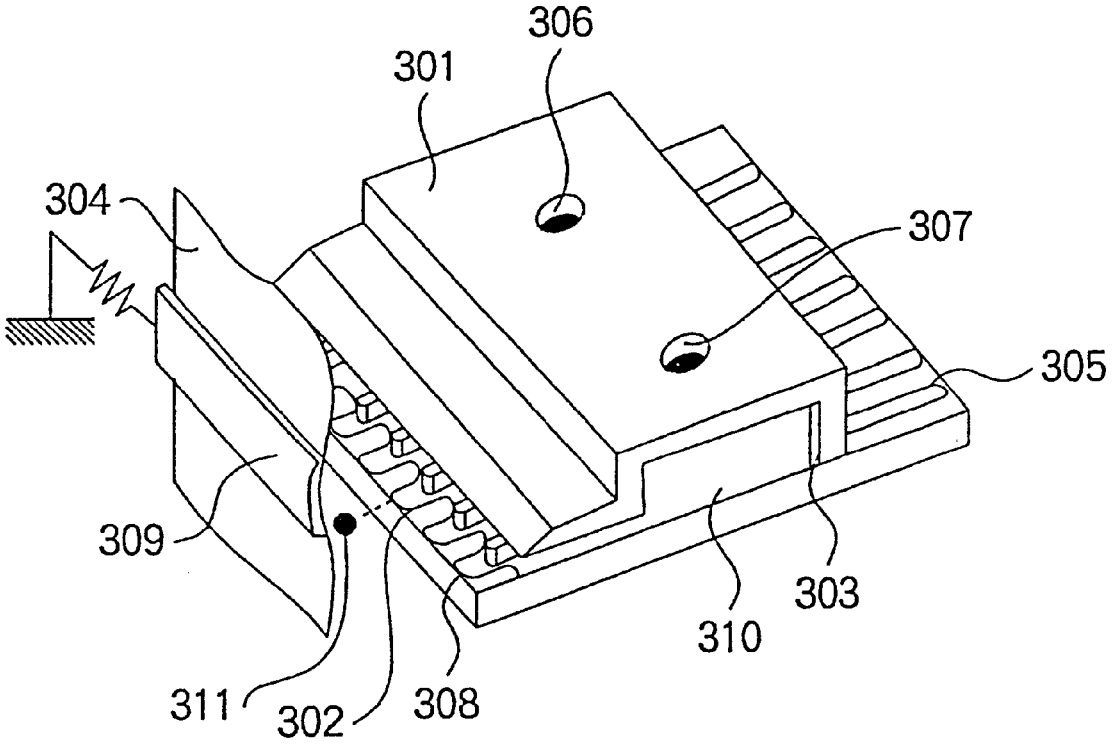
FIG. 1 PRIOR ART
FIG. 1 is a perspective view of a conventional ink jet recording head.
Figure 2A:
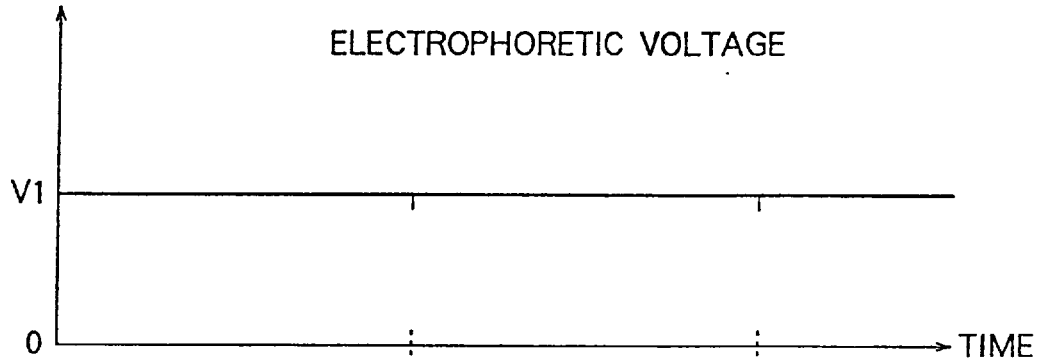
FIG. 2A PRIOR ART
FIG. 2 is a timing chart of the signals in the ink jet recording head of FIG. 1.
Figure 2B:
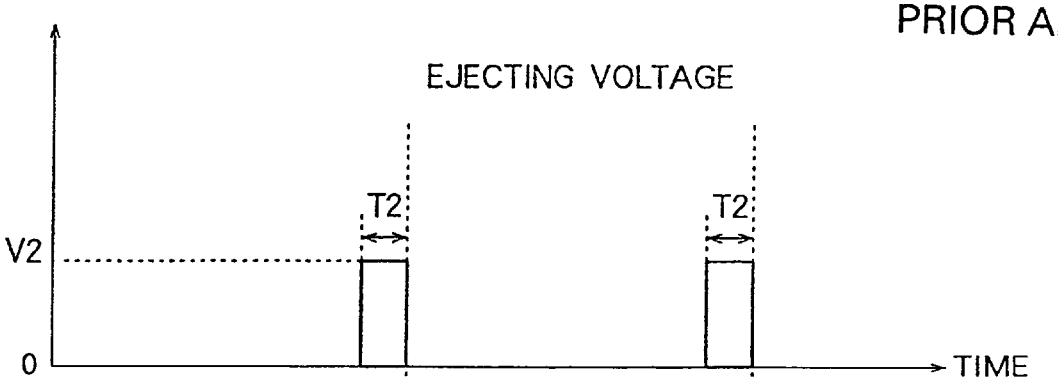
FIG. 2B PRIOR ART

Now, the present invention is more specifically described with reference to the accompanying drawings, wherein similar constituent elements are designated by the same or similar reference numerals in some embodiments.

Figure 3:
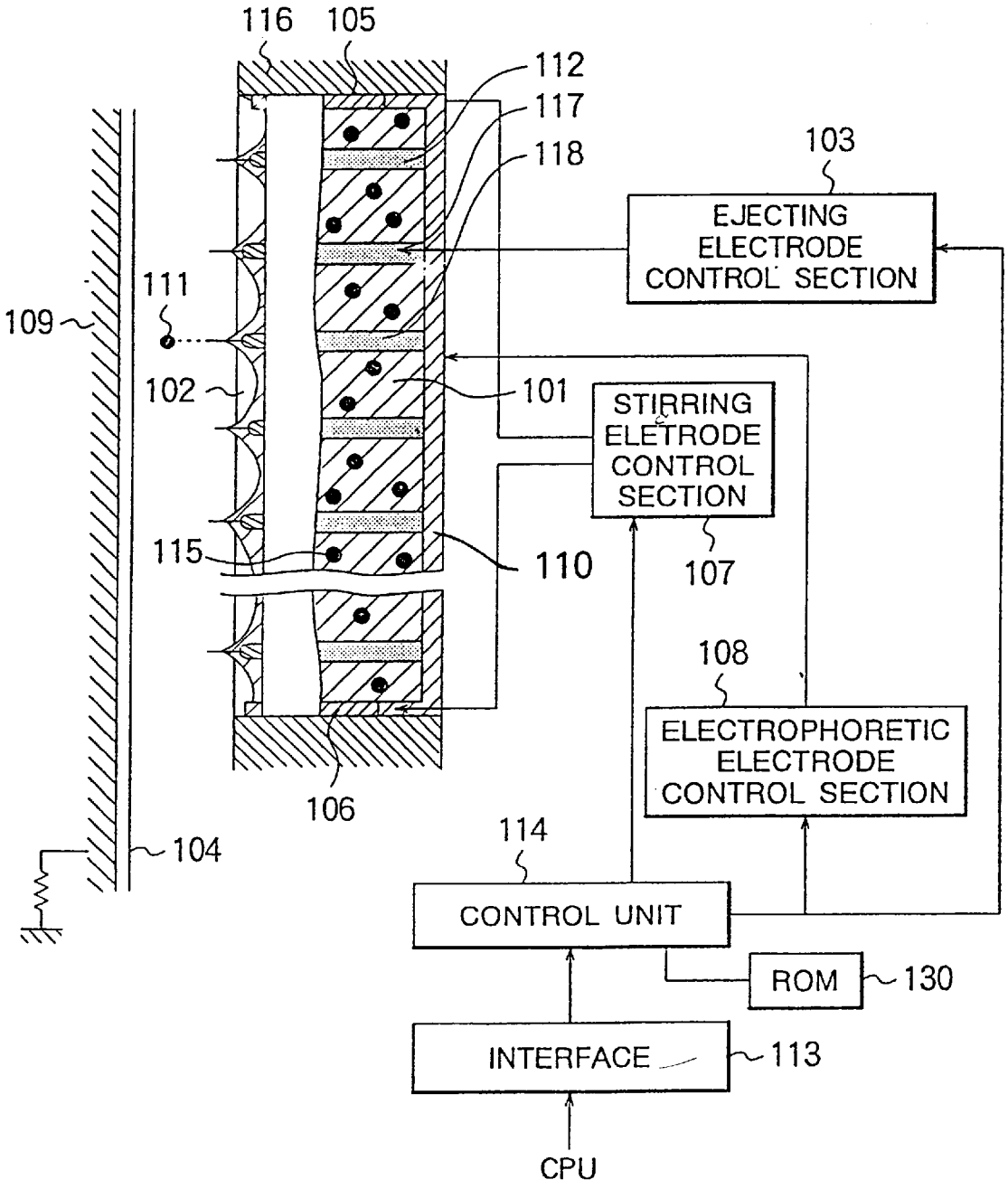
FIG. 3 is a schematic cross-sectional view of an ink jet recording head according to a first embodiment as well as a fourth embodiment of the present invention.

Referring to FIG. 3, an ink jet recording head according to a first embodiment of the present invention comprises an ink chamber 101 defined by a dielectric housing 116 for receiving therein pigmented ink, an electrophoretic electrode 110 disposed at the rear wall of the housing 116 for moving colored particles 115 in the pigmented ink by an electrophoretic force and concentrating the colored particles 115 in the vicinity of an ejecting slit 102 of the ink chamber 101, a plurality of elongate, ejecting electrodes 112, 117, 118 etc. disposed in a row along the ink jet slit 102 for ejecting colored particles 115 concentrated in the vicinity of the ejecting slit 102 toward a counter electrode 109 disposed behind a recording medium 104, all of which are similar to those in the conventional ink jet recording head of FIG. 1.

The ink jet recording head further comprises a pair of stirring electrodes 105 and 106 disposed at the both ends of the row of the ejecting electrodes 112, 117, 118 etc. and a set of control sections including a control unit 114 for receiving input data and control signals from a computer not shown in the figure via an interface 113 to control other control sections, an electrophoretic electrode control section 108 for applying an electrophoretic voltage to the electrophoretic electrode 110, a stirring electrode control section 107 for applying a stirring voltage to the stirring electrodes 105 and 106, and an ejecting electrode control section 103 for applying an ejecting voltage pulse to a specified one or group of the ejecting electrodes 112, 117, 118 etc.

Referring to FIG. 3, in general operation of the ink jet recording head of the present embodiment, a constant electrophoretic voltage V1 is applied to the electrophoretic electrode 110 for a set period of time to concentrate the colored particles at the tip of the ejecting electrodes 112, 117, 118 etc., followed by application of an alternate stirring voltage to the stirring electrodes 105 and 106 to stir the colored particles concentrated at the tips of the ejecting electrodes 112, 117, 118 etc. Then, an ejecting voltage pulse is applied to specified ejecting electrodes for ejecting colored particles from the specified ejecting electrodes. The alternating stirring voltage moves reciprocally the colored particles 115 concentrated in the vicinity of the ink jet slit 102 for stirring of the colored particles 115 for avoiding blocking of the ink jet slit 102.

Now a specific operation will be described for the case in that the print data and external control signals supplied from the computer via the interface 113 control the specified ejecting electrodes 112 and 118 to eject ink droplets 115, and control the ejecting electrode 117 not to eject an ink droplet.

The control unit 114 receives the print data and external control signal supplied from the computer via the interface 113 at the beginning of an interval "a" to generate a first control signal to the electrophoretic electrode control section 108, which responds to the first control signal to supply an electrophoretic voltage V1 to the electrophoretic electrode 110 during interval "a" for the time length of T1.

The ink chamber 101 receiving therein pigmented ink is applied with an electric field by the electrophoretic electrode 110. As a result, the colored particles 115 in the pigmented ink are moved toward the ink jet slit 102 at a constant electrophoretic mobility, whereby colored particles are concentrated at the tips of the ejecting electrodes 112, 117, 118 etc.

During the next interval "b", the control unit 114 delivers a second control signal to the electrophoretic electrode control section 108 and the stirring electrode control section 107. As a result, the electrophoretic electrode control section 108 cancels the electrophoretic voltage V1, whereas the stirring electrode control section 107 applies an alternating stirring voltage pulse, which alternates at a period of Tab between voltage levels Vab and −Vab for a time length of 3·Tab/2, to each of the pair of stirring electrodes 105 and 106 during the second interval "b". The polarities of the stirring electrodes 105 and 106 are opposite to each other, thereby applying charged colored particles with an alternating voltage.

After the electrophoretic voltage V1 is turned off at the end of interval "a", the movement of the colored particles toward the ink jet slit 102 stops. The colored particles 115 are then moved alternately in the opposite directions between the pair of stirring electrodes 105 and 106 at the period of Tab to be stirred in the pigmented ink, whereby the colored particles are moved in the vicinity of the tips of the ejecting electrodes 112, 117, 118 etc. during an interval "b1" for distribution of the colored particles.

At the end of interval "b1", the control unit 114 delivers a third control signal to the stirring electrode control section 107 and the ejecting electrode control section 103. The stirring electrode control section 107 cancels the alternating stirring voltage to stop the movement of the colored particles, whereby the colored particles are distributed uniformly in the vicinity of the tips of the ejecting electrodes 112, 117, 118 etc.

During a next interval "c", the ejecting electrode control section 103 responds to the control signal supplied from the control unit 114 to apply an ejecting voltage pulse having an amplitude of V2 and a duration of T2 to the specified ejecting electrodes 112 and 118, which drive the colored particles in the vicinities of the specified ejecting electrodes 112 and 118 from the tips of the electrodes 112 and 118 by an electrostatic force generated between the specified electrodes 112 and 118 and the counter electrode 109.

The colored particles 115 overcome the meniscus force, surface tension and viscosity of the pigmented ink by virtue of the electrostatic force, and are ejected as ink droplets 111 from the specified ejecting electrodes 112 and 118 at the timing in synchrony with the ejecting pulse, thereby forming an image on the recording medium 104. The colored particles 115 are not concentrated in the vicinity of the tip of the ejecting electrode 117, which is not specified for the ink ejection, thereby preventing the colored particles from being ejected from the non-specified ejecting electrode 117 irrespective of the influence by the driving pulses applied to the adjacent electrodes 112 and 118.

After a subsequent ink ejection from the ejecting electrodes 112 and 118 is requested, the control unit 114 again delivers during interval "c" a third control signal to the electrophoretic electrode control section 108, which responds thereto to supply an electrophoretic voltage V1 to the electrophoretic electrode 110 for the time length of T1, thereby generating an electric filed in the ink chamber 101 filled with the pigmented ink. The colored particles 115 in the pigmented ink are moved toward the ink jet slit 102 at the electrophoretic mobility during interval "c", thereby again causing concentration of colored particles in the vicinities of the ejecting electrodes 112, 117, 118 etc.

Subsequently, the control unit 114 delivers another second control signal to the electrophoretic electrode control section 108 and the stirring electrode control section 107 during a next interval "b2". The electrophoretic electrode control section 108 responds to the another second control signal to cancel the electrophoretic voltage V1 supplied to the electrophoretic electrode 110. The stirring electrode control section 107 also responds to the another second control signal to supply an alternating stirring voltage to the stirring electrodes 105 and 106 during interval "b2", similarly to the case of interval "b1".

After the electrophoretic voltage V1 is turned off at the end of interval "c", the colored particles 115 stop the movement toward the ink jet slit 102. The colored particles are then reciprocally moved in the opposite directions by the electrostatic force generated between the pair of stirring electrodes 105 and 106, whereby the colored particles are stirred and uniformly distributed in the vicinities of the tips of the ejecting electrodes 112, 117, 118 etc.

At the end of interval "b2", the control unit 114 delivers a fourth control signal to the stirring electrode control section 107 and the ejecting electrode control section 103. The stirring electrode control section 107 responds to the fourth control signal to cancel the stirring voltage supplied to the stirring electrodes 105 and 106 to thereby stop stirring of the colored particles, which are distributed uniformly in the vicinities of the ejecting electrodes 112, 117, 118 etc.

The ejecting electrode control section 103 also responds to the fourth control signal supplied from the control unit 114, thereby supplying an ejecting pulse to each of the ejecting electrodes 112 and 118, similarly to the case of interval "c". The colored particles disposed in the vicinities of the ejecting electrodes 112 and 118 are urged from the tips of the ejecting electrodes 112 and 118 and concentrated therein. The colored particles then overcome the meniscus force, surface tension and viscosity of the pigmented ink by virtue of the electrostatic force, to be ejected from the tips of the ejecting electrodes 112 and 118 onto the recording medium 104 while forming ink droplets 111. The colored particles disposed in the vicinity of the ejecting electrode 117 are not ejected therefrom because the colored particles are not concentrated in the vicinity of the ejecting electrode 117 irrespective of the influence by the voltage pulse applied to the adjacent ejecting electrodes 112 and 118.

In the above operation, if there is no request for ejection from either of the ejecting electrodes 112, 117, 118 etc., the control unit 14 delivers a control signal to the electrophoretic electrode control section 108, which responds thereto to cancel the electrophoretic voltage.

Figure 5:
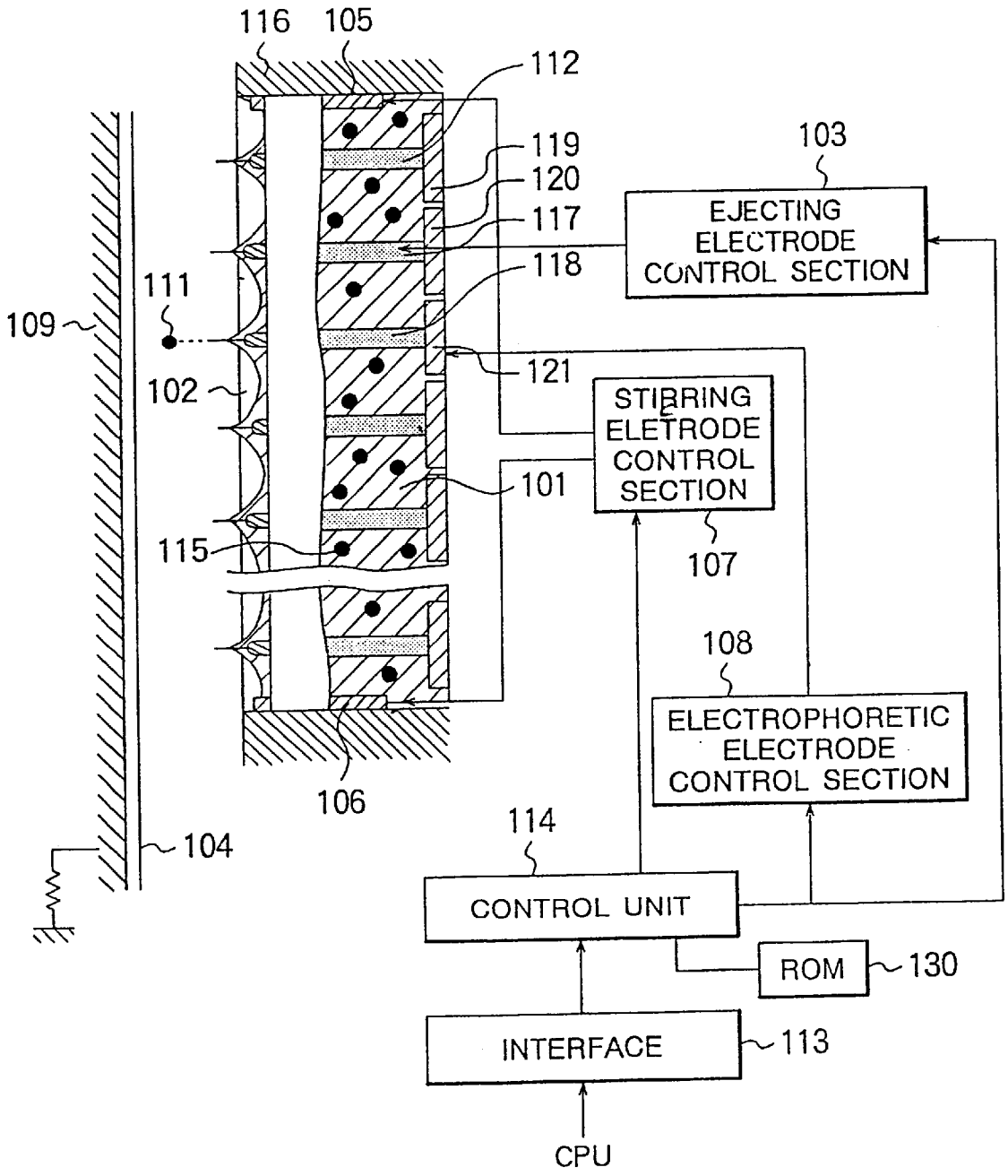
FIG. 5 is a schematic cross-sectional view of an ink jet recording head according to a second embodiment of the present invention.

Referring to FIG. 5, an ink jet recording head according to a second embodiment of the present invention is similar to the ink jet recording head of FIG. 3 except that a plurality of electrophoretic electrodes 119, 120, 121 etc. are disposed corresponding to the ejecting electrodes 112, 117, 118 etc. in the second embodiment. Similar constituent elements are designated by the same reference numerals in both the drawings, and detailed description thereof is omitted herein for avoidance of a duplication.

Figures 4A, 4B, 4C, 4D, 4E, 4F:
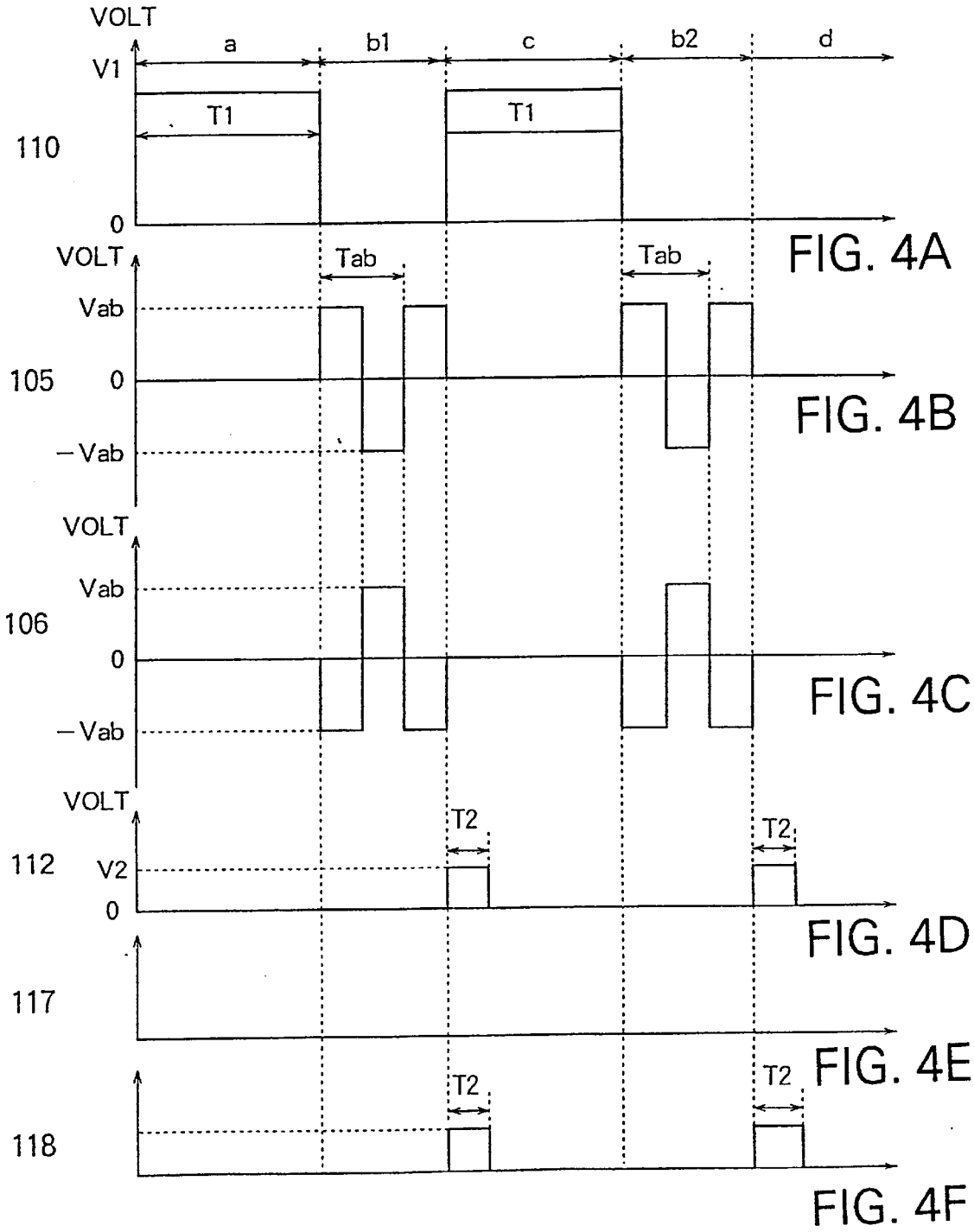
FIG. 4 is a timing chart of the signals in the ink jet recording head of FIG. 3.
Figures 6A, 6B, 6C, 6D, 6E, 6F, 6G, 6H:
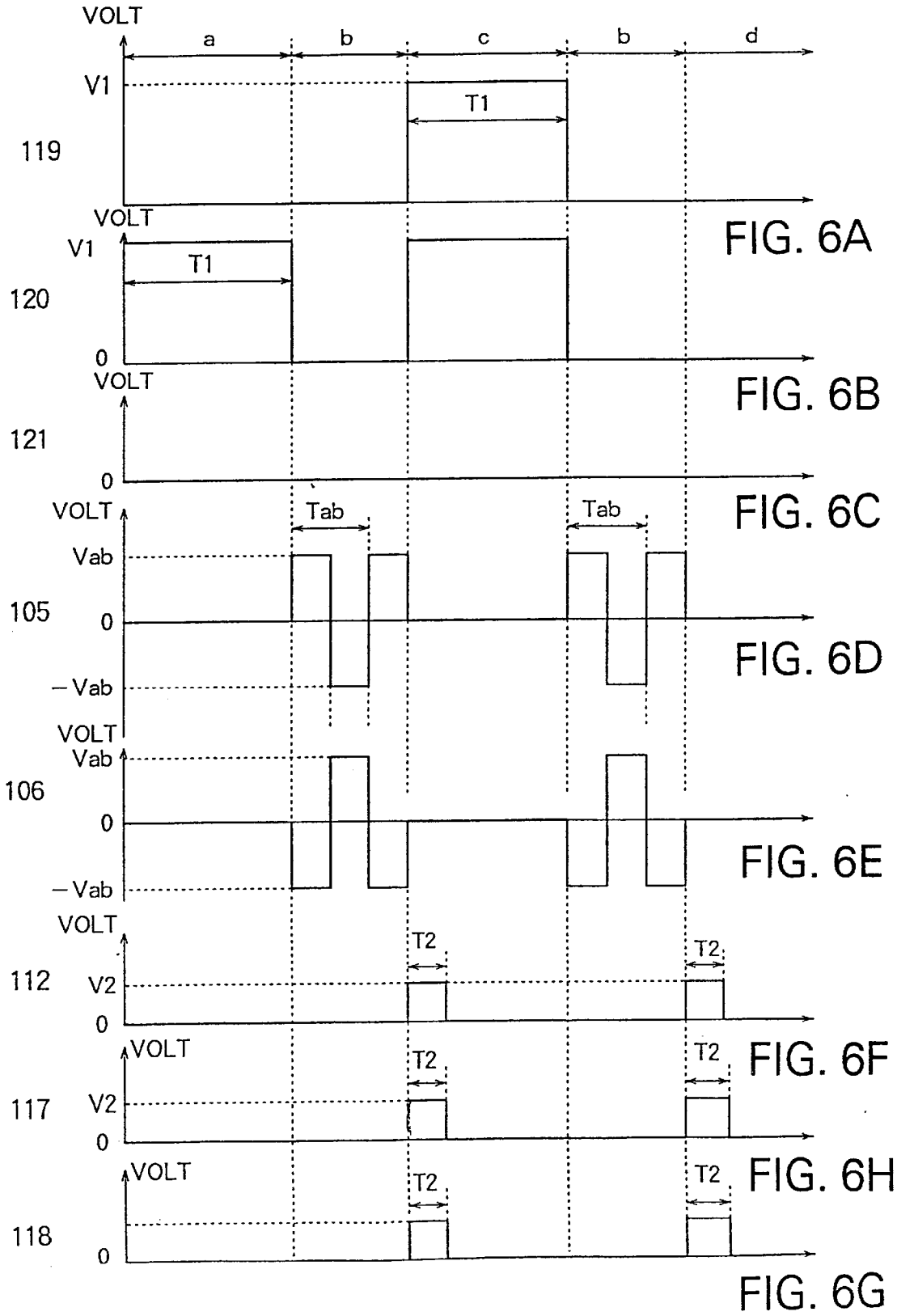
FIG. 6 is a timing chart of the signals in the ink jet recording head of FIG. 5.

Referring to FIG. 6 showing a signal timing chart of the second embodiment, similarly to FIG. 4, it is shown that each of the electrophoretic electrodes 119, 120, 121 etc. is applied with a constant electrophoretic voltage V1 for concentration of the colored particles for the time length T1 before a corresponding ejecting electrode is applied with an ejecting voltage pulse for ejection of the colored particles.

The stirring electrodes 105 and 106 are applied with an alternating stirring voltage pulse having a period of Tab for stirring the colored particles between the activation of the electrophoretic electrode and the activation of the corresponding ejecting electrode. The stirring voltage pulse is applied for the time length of 3·Tab/2.

In the second embodiment, since colored particles 115 are not concentrated in the vicinity of the tips of the ejecting electrodes not specified for the ink ejection, it is more assured that the colored particles are not ejected by the activation of the adjacent ejecting electrode compared to the first embodiment.

In the first and second embodiments, the pair of stirring electrodes 105 and 106 disposed at both edges of the ejecting slit function for stirring colored particles in the vicinities of the tips of the ejecting electrodes not specified for ink ejection, thereby preventing concentration of the colored particles in the vicinities. As a result, an undesirable ejection of colored particles due to the activation of the adjacent ejecting electrodes are prevented to obtain a stable image quality.

Figure 7:
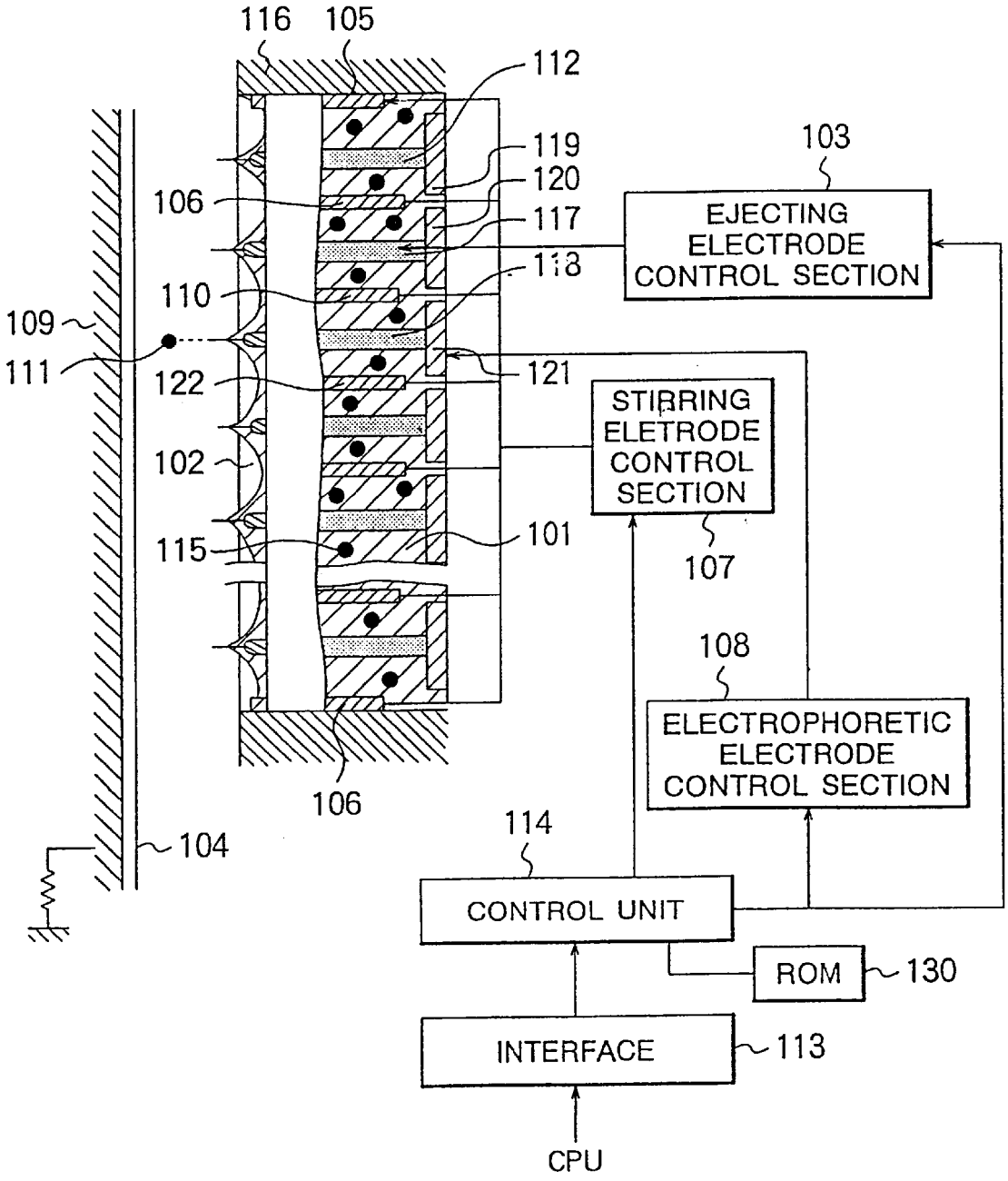
FIG. 7 is a schematic cross-sectional view of an ink jet recording head according to a third embodiment of the present invention.

Referring to FIG. 7, an ink jet recording head according to a third embodiment of the present invention is similar to the ink jet recording head shown in FIG. 5 except that a pair of stirring electrodes are disposed at both sides of each ejecting electrode 112, 117, 118, . . . in the present embodiment. Similar constituent elements are designated by the same reference numerals in both the drawings, and detailed description thereof is avoided herein for avoiding a duplication.

Figures 8A, 8B, 8C, 8D, 8E, 8F, 8G, 8H, 8I, 8J:
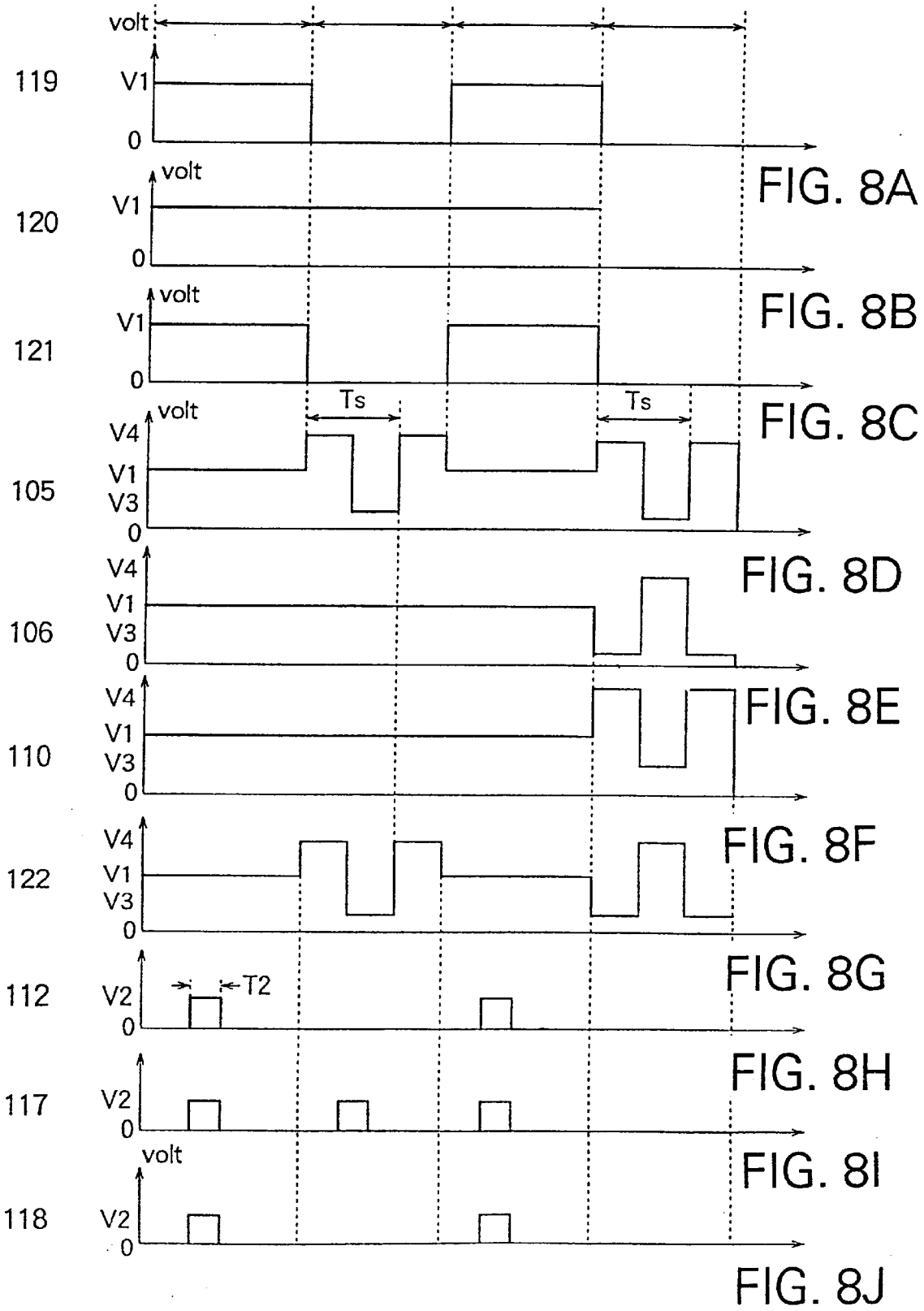
FIG. 8 is a timing chart of the signals in the ink jet recording head of FIG. 7.

Referring to FIG. 8 showing a timing chart of the ink jet recording head of FIG. 7, the control unit 114 receives printing data and external control signals from a computer via the interface 113 for ejecting colored particles 115 from, for example, ejecting electrodes 112, 117 and 118. By this print data and control signals, the ejecting electrode 117 repeats ejection of the colored particles at a short time interval, whereas both the ejecting electrodes 112 and 118 disposed at both sides of the ejecting electrode 117 repeat the ejection at a larger time interval.

The control unit 114 delivers a first control signal to the electrophoretic electrode control section 108 and the stirring electrode control section 107 at the beginning of interval "a". The electrophoretic electrode control section 108 responds to the first control signal to supply constant electrophoretic voltages V1 to the specified electrophoretic electrodes 119, 120 and 121 for generation of electric field in the ink chamber 101 in the vicinity of the specified electrophoretic electrodes. As a result, the colored particles in the pigment ink are moved toward the ink jet slit 102 at the constant electrophoretic mobility, to be concentrated in the vicinities of the specified ejecting electrodes 112, 117 and 118. On the other hand, the stirring electrode control section 107 respond to the first control signal to supply a constant stirring voltage V1 to each of the stirring electrodes 105, 106, 110, and 122 disposed adjacent to the specified ejection electrodes.

The control unit 14 also delivers the first control signal to the ejecting electrode control section 103, which responds thereto to supply an ejecting voltage pulse having an amplitude of V2 and a duration of T2 to each of the specified ejecting electrodes 112, 117 and 118. The colored particles 115 in the vicinity of the ejecting slit 102 are urged from the tips of the ejecting electrodes 112, 117 and 118. The colored particles 115 overcome the meniscus force, surface tension and viscosity of the pigmented ink by virtue of the electrostatic force applied thereto, to be ejected from the tips of the respective ejecting electrodes 112, 117 and 118 at the timing in synchrony with the ejecting voltage pulse and adhered onto the recording medium 104.

At the end of interval "a", the control unit 114 receives print data and external control signals for ejecting colored particles 115 only from the ejecting electrode 117, and delivers a second control signal to the electrophoretic electrode control section 108 and the stirring electrode control section 107. The electrophoretic electrode control section 108 responds thereto to cancel the electrophoretic voltage V1 supplied to the ejecting electrodes 112 and 118 which are not specified for ink ejection.

The stirring electrode control section 107 responds to the second control signal to reciprocally change the stirring voltages supplied to the stirring electrodes 105 and 122 between voltage levels V4 and V3 wherein V3<V1<V4 at a period of Ts for a time length of 3·Ts/2, with the stirring voltages V1 supplied to the remaining stirring electrodes 106 and 110 which sandwich the specified ejecting electrode 117 being unchanged.

After the electrophoretic voltages supplied to the electrophoretic electrodes 119 and 121 are turned off at the end of interval "a", colored particles 15 stop themovement toward the inkjet slit 102. In addition, the direction of the electric field between the stirring electrodes 105 and 106 and between the stirring electrodes 110 and 122 changes at a period of Ts/2 because the stirring voltages supplied to the stirring electrodes 105 and 122 sandwiching the stirring electrodes 106 and 110 change at a period of Ts from the constant stirring voltage V1. As a result, the colored particles 115 in the vicinities of the tips of the ejecting electrodes 102 and 108 are moved in the opposite directions at the period of Ts/2 between the ejecting electrodes 105 and 106 and between ejecting electrodes 110 and 122, and stirred.

In this operation, the colored particles 115 are moved uniformly in the vicinities of the tips of the ejecting electrodes 112 and 118. Since the constant stirring voltage V1 is applied to the stirring electrodes 106 and 110, the change in the electric field as described above does not influence the electric field between the stirring electrodes 106 and 110 sandwiching the specified ejecting electrode 117.

The control unit 114 also delivers the second control signal during interval "b" to the ejecting electrode control section 103, which responds thereto to supply an ejecting voltage pulse having an amplitude of V2 and a duration of T2 to the ejecting electrode 117. As a result, the colored particles 115 in the vicinity of the tip of the ejecting electrode 117 are moved to the tip of the ejecting electrode 117 by the electrostatic force generated therein and are concentrated at the tip. The colored particles 115 then overcome the meniscus force, surface tension and viscosity of the pigmented ink by virtue of the electrostatic force at a timing in synchrony with the ejecting voltage pulse, to be ejected as ink droplets 111 onto the recording medium 104.

At the beginning of interval "c", the control unit 114 receives printing data and external control signals for ejection from the ejecting electrode 112, 117 and 118. The control unit 114 delivers a third control signal to the stirring electrode control section 107 and the electrophoretic electrode control section 108. The stirring electrode control section 107 responds to the third control signal to supply a constant stirring voltage V1 to the stirring electrodes 105 and 122. As a result, the colored particles 115 in the vicinities of the tips of the ejecting electrodes 112 and 118 stops the movement, whereby the colored particles 115 are distributed uniformly in the vicinities of the ejecting electrodes 112 and 118.

On the other hand, the electrophoretic electrode control section 108 responds to the third control voltage to again supply an electrophoretic voltage V1 during interval "c" to each of the electrophoretic electrodes 119, 120 and 121, thereby generating an electric field in the ink chamber 101 filled with the pigmented ink. The colored particles 115 in the pigmented ink are moved at the electrophoretic mobility toward the ink jet slit 102, whereby the colored particles 115 are concentrated in the vicinities of the tips of the ejecting electrodes 112, 117 and 118.

The control unit 114 also delivers the third control signal to the ejecting electrode control section 103, which responds thereto to supply an ejecting voltage having an amplitude of V2 and a duration of T2 to the ejecting electrodes 112, 117 and 118. The colored particles 115 distributed in the vicinities of the tips of the ejecting electrodes 112, 117 and 118 are urged from tips of the ejecting electrodes 112, 117 and 118 by the electrostatic force thus generated, and are concentrated therein.

The colored particles 115 in the vicinities of the tips of the ejecting electrodes 112, 117 and 118 overcome the meniscus force, surface tension and viscosity of the pigmented ink by virtue of the electrostatic force, to be ejected from the ejecting electrodes 112, 117 and 118 as ink droplets onto the recording medium during interval "c".

At the end of interval "c", the control unit 114 receives print data and external control signals for non-ejection from any of the ejecting electrodes 112, 117, 118 etc. The control unit 114 delivers a fourth control signal to the electrophoretic electrode control section 108 and the stirring electrode control section 107. The electrophoretic electrode control section 108 responds thereto to cancel the electrophoretic voltage supplied to the electrophoretic electrode 119, 120 and 121. The stirring electrode control section 107 also responds to the fourth control signal to supply alternating stirring voltages to the stirring electrodes 105, 106, 110 and 122. The alternating stirring voltages change their level between V4 and V3 wherein V3<V1<V4, and has opposite polarities between the stirring electrodes 105 and 106 and between the stirring electrodes 110 and 122 at a period of Ts and for a time length of 3·Ts/2.

The colored particles 115 stop movement toward the ink jet slit 102 after the electrophoretic voltage is turned off at the electrophoretic electrodes 119, 120 and 121 at the end of interval "c". Instead, the alternating stirring voltage reciprocally moves the colored particles in the vicinity of the ink jet slit 102 in the opposite directions for stirring. The colored particles 115 are distributed substantially uniformly in the vicinities of the ejecting electrodes 112, 117, 118 etc. for preparing a next ejection. Thereafter, the alternating stirring voltage is turned off for stopping the recording.

The ink jet recording head of the present embodiment has an advantage in preventing the colored particles which are not ejected and remain in the vicinity of the ink jet slit from being concentrated and ejected from the non-specified ejecting electrode as well as in preventing the block of the ink jet slit by the colored particles not ejected, thereby obtaining a stable recording and an excellent image quality.

An ink jet recording head according to a fourth embodiment of the present invention is similar to the first embodiment of FIG. 3 except for the program stored in the ROM 130. In the present embodiment, the recording head can be shifted in a standby mode canceling the stirring voltage after a specified time length elapsed since the start of the application of the stirring voltage by.

Figure 9:
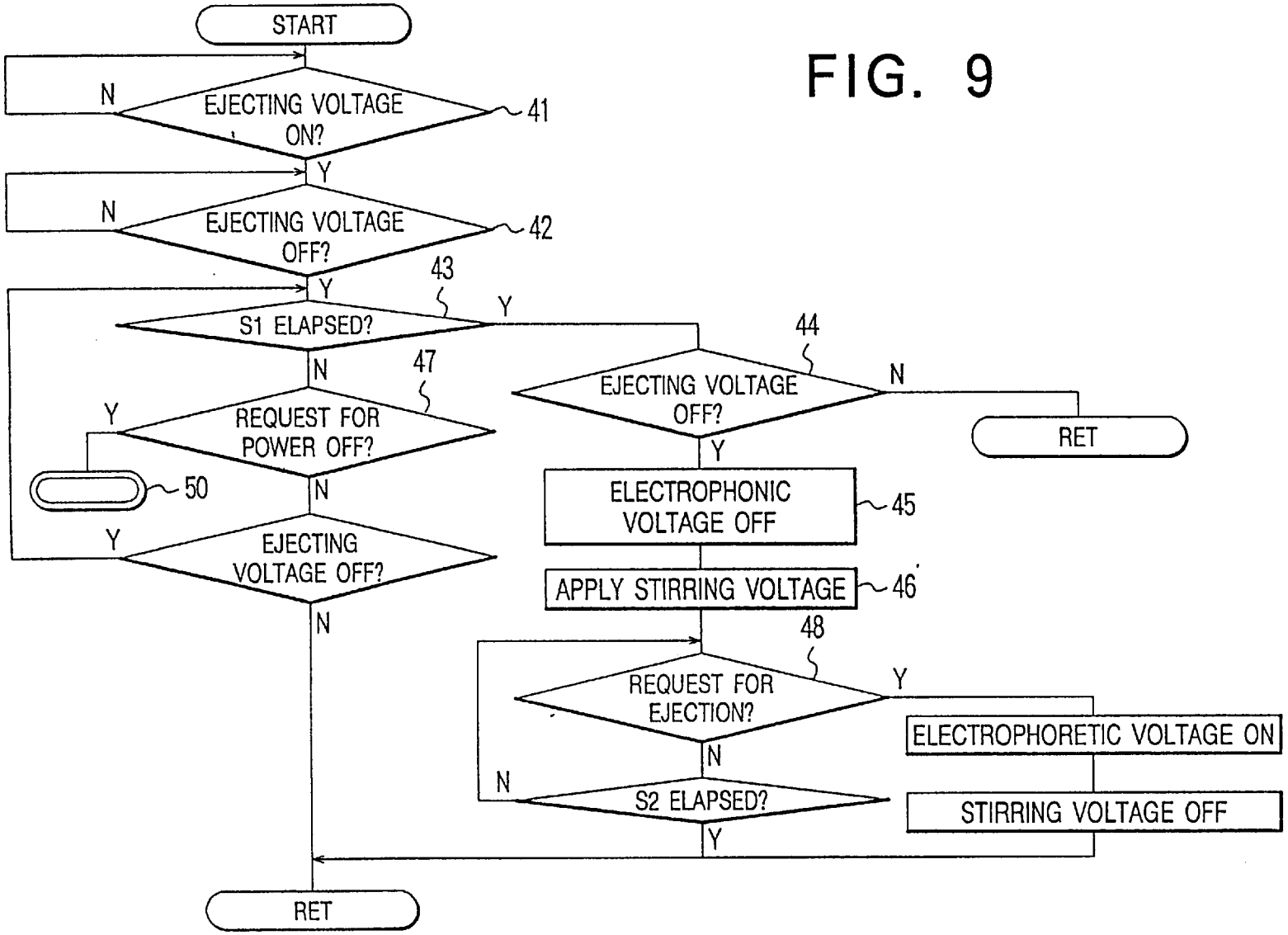
FIG. 9 is flowchart of the operation of the ink jet recording head according to a fourth embodiment of the present invention.

FIG. 9 is a flowchart of the program stored in the ROM 130. The control unit 114 monitors the time length that elapsed since the time instant at which an ejecting voltage pulse having an amplitude of V2 and a duration of T2 is applied to the ejecting electrode 112 at step 41, and also the time length that elapsed since the ejecting voltage is cancelled at step 42.

Figures 10A, 10B, 10C, 10D:
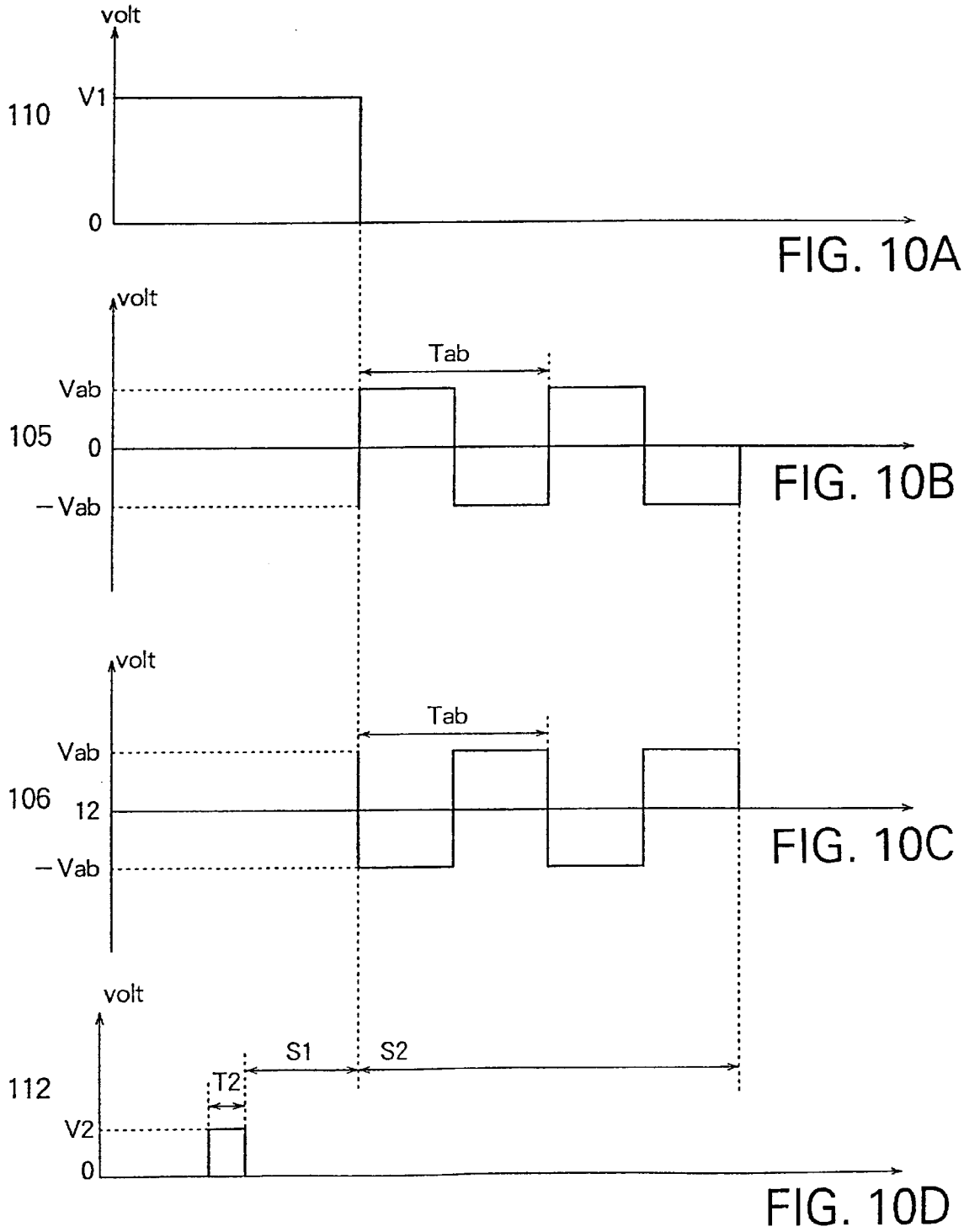
FIG. 10 is a timing chart of the signals in the ink jet recording head of FIG. 9.

If it is detected that a time length of S1 elapsed since the turn-off of the ejecting electrode at step 43, as shown in FIG. 10, the control unit 114 delivers a first control signal to the electrophoretic electrode control section 108 and the stirring electrode control section 107. The electrophoretic electrode control section 108 responds to the first control signal to cancel the electrophoretic voltage V1 supplied to the electrophoretic electrode 110 at step 45. At step 46, the stirring electrode control section 107 responds to the first control signal to change the stirring voltages supplied to the stirring electrodes 105 and 106 between the voltage levels Vab and −Vab at a period of Tab, with the polarities of the stirring voltages being opposite to each other. The colored particles 115 stop the movement toward the ink jet slit 102 after the electrophoretic voltage is turned off, and the colored particles in the vicinity of the ejecting electrodes are moved reciprocally in the opposite directions along the ink jet slit 102 by the alternating stirring voltage applied between the stirring electrodes 105 and 106.

If there is no request for ink ejection at steps 48 and 49 from the computer for the next time interval S2, the colored particles 115 are reciprocally moved along the ink jet slit 102 by the alternating stirring pulse at the period Tab for stirring the colored particles 115. The colored particles 115 are distributed uniformly in the vicinity of the ink jet slit 102 by the stirring to enter a standby mode for preparing a next ink ejection beginning at step 41.

Figures 11A, 11B, 11C, 11D:
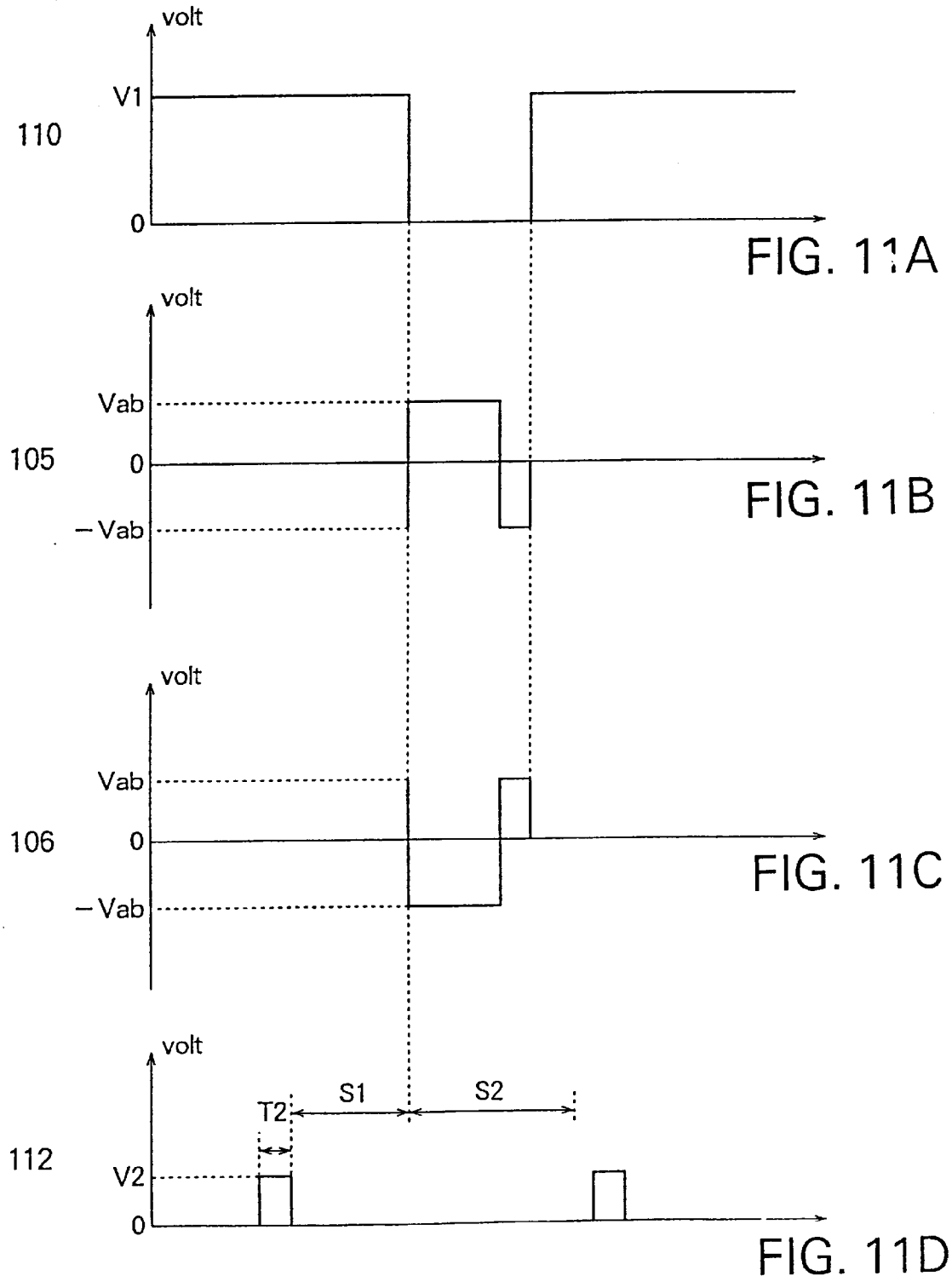
FIG. 11 is another flowchart of the operation of the ink jet recording head of FIG. 9.

Referring to FIG. 11, the electrophoretic electrode control section 108 responds to the first control signal from the control unit 114 at step 45 to cancel the electrophoretic voltage V1 supplied to the electrophoretic electrode 110. The stirring electrode control section 107 also responds to the first control signal to supply an alternating stirring voltage pulse at step 46 to the pair of stirring electrodes 105 and 106. If the control unit 114 detects a request for the ink ejection at step 48 from the computer before the time length S2 elapses, the control unit 14 delivers a second control signal to the electrophoretic electrode control section 108 and the stirring electrode control section 107. The electrophoretic electrode control section 108 again supplies an electrophoretic voltage V1 to the electrophoretic electrode 110 by responding to the second control signal.

On the other hand, the stirring electrode control section 107 cancels the alternating stirring voltage supplied to the stirring electrodes 105 and 106. After the electrophoretic voltage V1 is supplied to the electrophoretic electrode 110, the colored particles 115 in the pigmented ink are moved toward the ink jet slit 102, and are concentrated in the vicinity of the ink jet slit 102. When an ejecting voltage pulse is applied to a specified ejecting electrode 112, the colored particles are ejected therefrom as ink droplets, to be adhered onto the recording medium.

Figure 12:
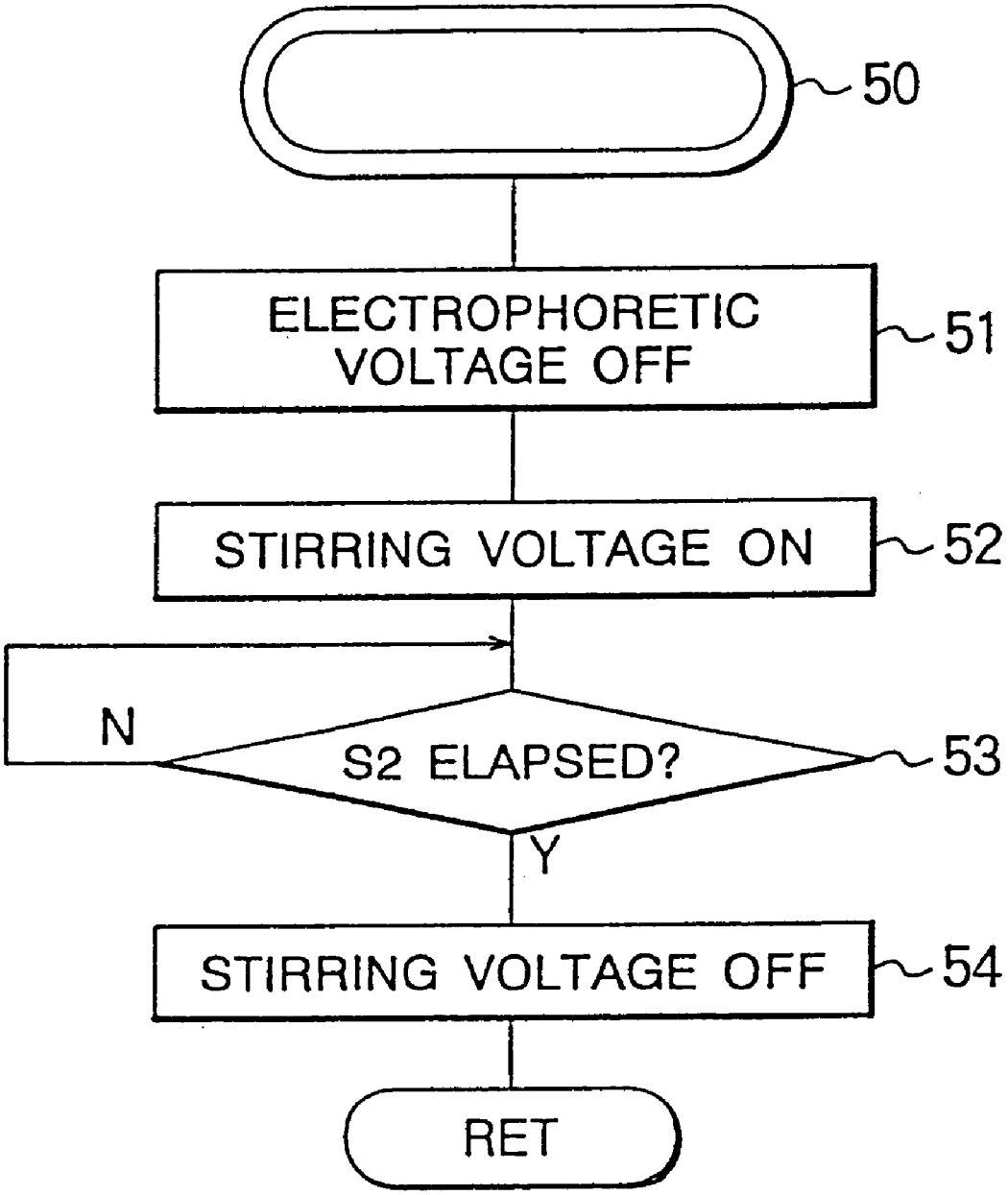
FIG. 12 is detailed flowchart in the step of FIG. 11.

FIG. 12 shows a flow-chart of another case wherein the control unit 114 detects a request for a power-off at step 47 in FIG. 9 before the time length SI elapses since the end of the ejecting voltage applied to the specified ejecting electrode 112. After the control unit detects the request for the power-off at step 47 in FIG. 9, the control unit 114 delivers a control signal to the electrophoretic electrode control section 108 and the stirring electrode control section 107.

The electrophoretic electrode control section 108 responds to the control signal at step 51 to cancel the electrophoretic voltage supplied to the electrophoretic electrode 110, thereby stopping the movement of the colored particles 115 toward the ink jet slit. The stirring electrode control section 107 also responds to the control signal to supply an alternating stirring voltage to the stirring electrodes 105 and 106 at step 52, thereby reciprocally moving the colored particles in the vicinities of the ink jet slit between the ejecting electrodes 105 and 106 in opposite directions.

After the control unit 114 detects a time length of S2 elapsed at step 53, the control unit 14 delivers another control signal to control the stirring electrode control section 107 to cancel the stirring voltage at step 54. Thereafter, the power supply for the recording head is turned off.

Figure 13A:
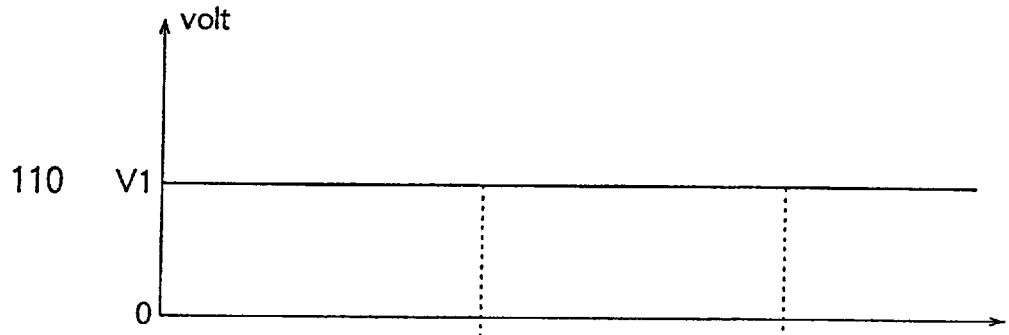
FIG. 13 is another timing chart of the signals in the ink jet recording head of FIG. 9.
Figure 13B:
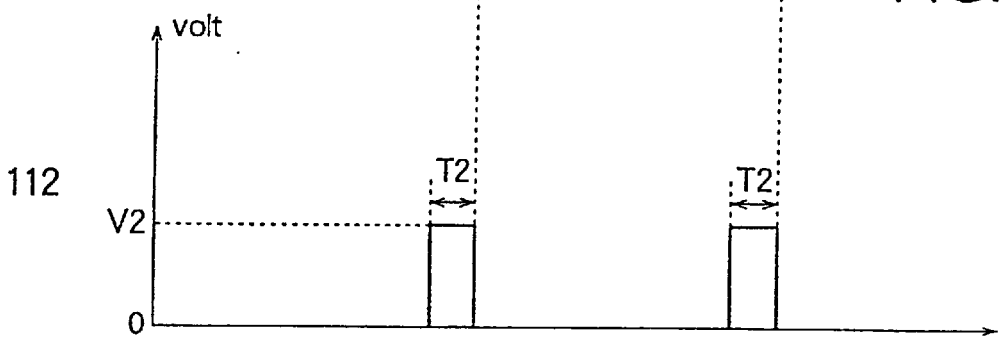

Referring to FIG. 13, there is shown a timing chart of the ink jet recording head of the present embodiment, wherein ejecting voltage is repeatedly applied without an interval of S1. The stirring electrode control section supplies a constant voltage to the stirring electrodes.

In the operation of the fourth embodiment of the present invention, since the stirring electrodes 105 and 106 are controlled depending on the next state of the ink jet recording head, the colored particles are uniformly distributed along the ink jet slit during an inoperative state of the ink jet recording head, thereby preventing the ink jet slit 102 from being blocked by the colored particles 115 not ejected for a long time.

Figure 14:
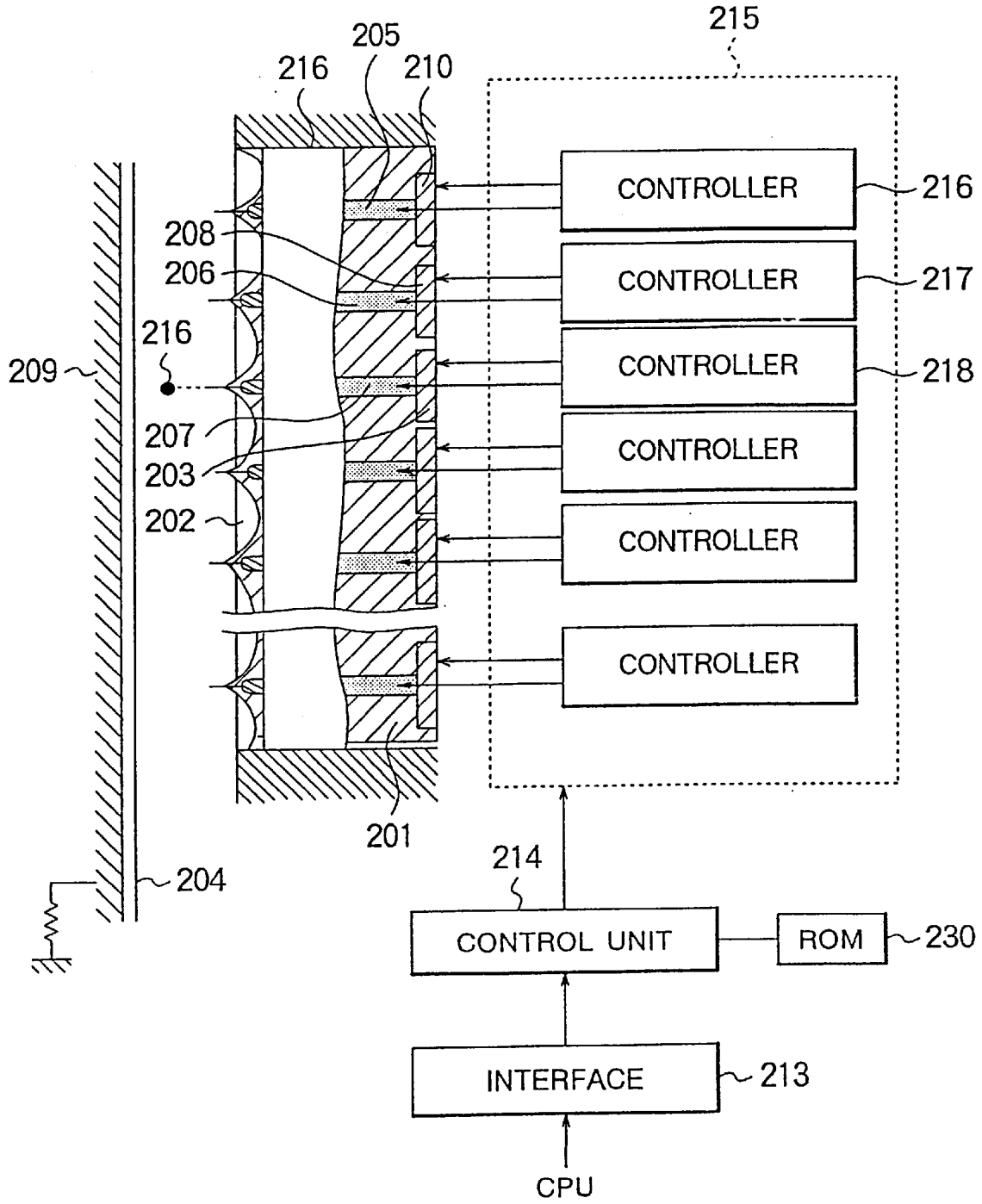
FIG. 14 is a schematic cross-sectional view of an ink jet recording head according to a fifth embodiment of the present invention.
Figure 15A:
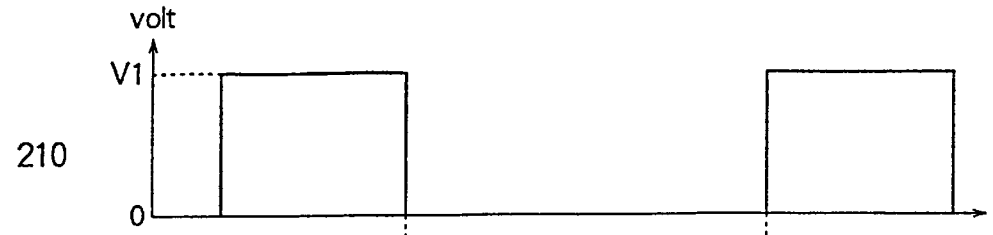
FIG. 15 is a timing chart of the signals in the ink jet recording head of FIG. 14.
Figure 15B:
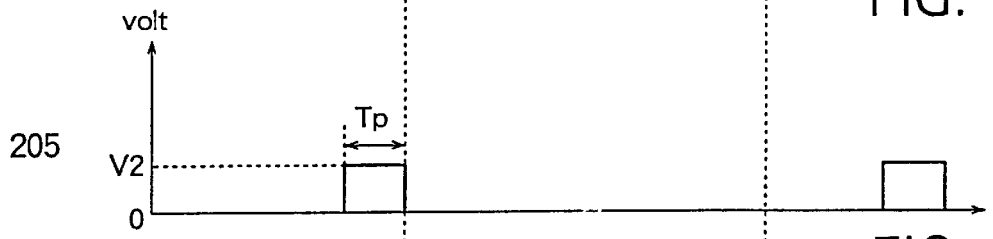
Figure 15C:
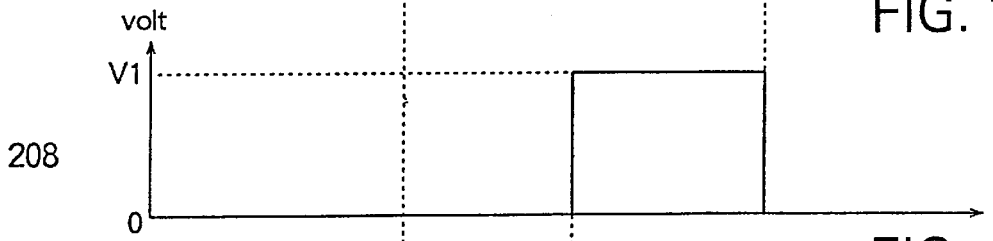
Figure 15D:
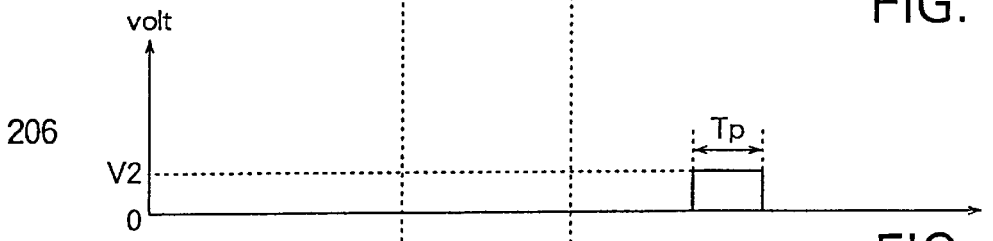
Figure 15E:
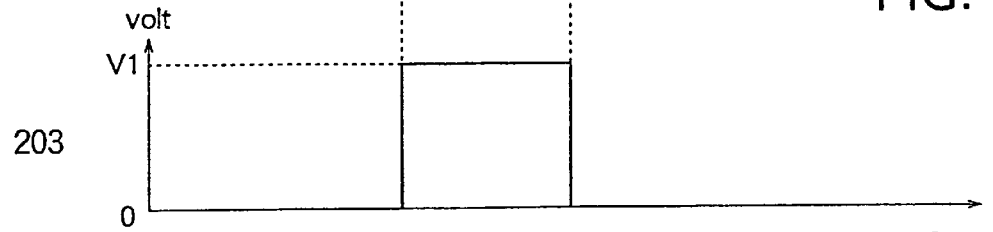
Figure 15F:
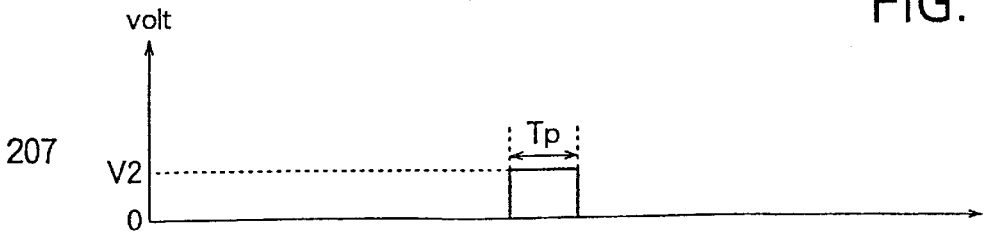

Referring to FIG. 14, an ink jet recording head according to a fifth embodiment of the present invention comprises an ink chamber 201 defined by a dielectric housing 216, a plurality of electrophoretic electrodes 210, 208, 203 etc., a plurality of ejecting electrodes 205, 206, 207 etc. each corresponding to one of the electrophoretic electrodes, a counter electrodes 209 disposed behind a recording medium 204, which receives ink droplets 216 ejected by the ejecting electrode, an interface 213, a control unit 214 having a ROM 230, and an electrode control section 215 including a plurality of controllers 216, 217, 218 etc. each for controlling voltages for a pair of electrophoretic electrode and ejecting electrode. Those elements in the present embodiment have respective functions similar to those described in connection with the first through fourth embodiment.

Referring to FIG. 15 showing a timing chart of the present embodiment, there is shown a case wherein ejecting electrodes 205, 207 and 206 are consecutively activated for ejection of ink droplets 211 of the colored particles from the ink jet slit 202.

In operation, the control unit 214 receives printing data and external control signals to determine which pair of electrophoretic electrode and ejecting electrode should be applied with driving voltages as well as which driving voltage should be provided to each of the pair thus determined. The control unit 214 then supplies a first control signal to the first controller 216 for driving the first pair of electrophoretic electrode 210 and ejecting electrode 205.

The first controller 216 supplies a constant electrophoretic voltage V1 to the electrophoretic electrode 210 for the first interval, and supplies an ejecting voltage pulse having an amplitude of V2 and a duration of Tp to an ejecting electrode 205 at the end of the first interval for ejection of colored particles. Other pairs of electrophoretic electrode and ejecting electrode are not applied with driving voltages and maintained at zero potential.

After the driving voltages for the first pair of electrophoretic electrode 210 and ejecting electrode 205 are cancelled, the second pair of electrophoretic electrode 203 and ejecting electrode 207 are applied with driving voltages similarly to the first pair by the second controller 218. The third pair of electrophoretic electrode 208 and ejecting electrode 206 are then driven similarly by the third controller 217.

In the present embodiment, the pair of electrophoretic electrode and ejecting electrode are driven within a single interval so that colored particles are concentrated only in the vicinity of the specified ejecting electrode just before ejection, thereby avoiding undesirable ejection of the colored particles from non-specified ejecting electrodes.

Since the above embodiments are described only for examples, the present invention is not limited to the above embodiments and various modifications or alterations can be easily made therefrom by those skilled in the art without departing from the scope of the present invention.

What is claimed is:

1. An ink jet recording head comprising a housing defining an ink chamber having an ink jet slit at a front side thereof for ejecting colored particles in pigmented ink, at least one electrophoretic electrode disposed at a rear side of said ink chamber receiving an electrophoretic voltage for moving said colored particles by an electrophoretic force, a plurality of ejecting electrodes having respective tips arranged in a row along said ink jet slit, each of said ejecting electrodes receiving an ejecting voltage, a counter electrode opposed to said row of tips of said ejecting electrodes and maintained at a potential, and a pair of stirring electrodes, one of said stirring electrodes being disposed at each end of the row of the tips of said ejecting electrodes, said stirring electrodes receiving a stirring voltage therebetween that reverses polarity at least once to move the particles perpendicular to an ink election direction.

2. An ink jet recording head as defined in claim 1, wherein said stirring electrodes receive the stirring voltage in the absence of said electrophoretic voltage and said ejecting voltage.

3. An ink jet recording head as defined in claim 1 further comprising additional stirring electrodes that are each disposed between a different pair of adjacent tips of said ejecting electrodes.

4. An ink jet recording head as defined in claim 3, wherein said at least one electrophoretic electrode includes a plurality of electrophoretic electrodes disposed corresponding to said ejecting electrodes.

5. An ink jet recording head as defined in claim 1, further comprising a timer for measuring a time length elapsed since an end of said ejecting voltage to output a timing signal, and a control unit for responding to said timing signal to generate a stirring signal for application of said stirring voltage.

6. An ink jet recording head as defined in claim 5, wherein said control unit generates said stirring signal when said electrophoretic voltage is off.

7. An ink jet recording head as defined in claim 6, wherein said control unit stops said stirring signal after a time length elapses since the generation of said stirring signal before a standby mode of said ink jet recording head.

* * * * *